United States Patent [19]

DeVore et al.

[11] Patent Number: 4,682,706

[45] Date of Patent: Jul. 28, 1987

[54] TAMPER INDICATOR FOR USE WITH A RECLOSABLE CONTAINER ASSEMBLY

[75] Inventors: Frank C. DeVore, Orange; Marcos A. Argudo, Chino, both of Calif.

[73] Assignee: Tri Plas, Inc., Ontario, Calif.

[21] Appl. No.: 876,391

[22] Filed: Jun. 20, 1986

[51] Int. Cl.[4] ..... B65D 41/32

[52] U.S. Cl. ..... 220/276; 215/256; 320/270

[58] Field of Search ..... 220/270, 276; 215/256

[56] References Cited

U.S. PATENT DOCUMENTS 3,979,003 9/1976 Allen ..... 215/256

4,488,658 12/1984 Smith et al. ..... 220/276

*Primary Examiner*—George T. Hall

*Attorney, Agent, or Firm*—Sixbey, Friedman & Leedom

[57] ABSTRACT

A reclosable container assembly (10) includes a container (12) having a locking ledge (18) thereon and a closure member (14) having a locking skirt (34) thereon. A tamper indicator and tear-off strip (44) which has a plurality of spaced apart grooves (60) defined in the inner surface (54) thereof is attached to the closure member skirt by a hinge 50. A web (62) covers each groove so that the tear-off strip outer member appears smooth. The web over each groove is adapted to break when a relatively small force is applied at any location along the tear-off strip between the grooves to indicate that the assembly has been tampered with.

11 Claims, 7 Drawing Figures

TAMPER INDICATOR FOR USE WITH A RECLOSABLE CONTAINER ASSEMBLY

TECHNICAL FIELD

The present invention relates, in general, to reclosable container assemblies, and more particularly, to a tamper indicator for use on such assemblies.

BACKGROUND ART

Current retail store product display practices typically require packaged consumer products to be left unattended and, therefore, subject to malicious tampering by unscrupulous individuals. Such tampering may occur with any packaged product, but products packaged in reclosable container assemblies are especially vulnerable because a closure member can be removed from the container and replaced, thereby concealing the fact that entry to the container has occurred. In order to protect a consumer from unknowingly purchasing a tamper damaged product packaged in a reclosable container, it is important to provide evidence which will alert a purchaser or the seller that the container has been opened.

Because of the hazards to both the purchaser and the seller which may be associated with contaminated or adulterated foods, merely providing evidence that a package has been opened is not sufficient. It is also important that evidence of tampering anywhere on a container-closure member attachment be presented in a readily apparent, non-concealable manner so that a consumer will be apprised of a potential problem even if he is not consciously looking for such evidence.

In the past, the problem of preventing undetected entry into a closed reusable container has been recognized. For example, containers and closure members of the type disclosed in U.S. Pat. Nos. 3,753,511, 3,979,003 and 4,190,175 have been developed to protect against unauthorized opening of a closed container by providing a tear-off portion of the closure lid which is damaged by manipulation of a pull tab. However, such devices may not provide evidence of unauthorized entry or attempted entry into the closed container at all locations on the closure member-container joint, and any evidence which might be produced may be concealed and not readily apparent. Furthermore, in such arrangements, unauthorized entry to the contents of the container may be made by working one's fingers under a tearable portion of the closure member or simply by exerting sufficient upward force on the closure to work the closure member off the container without damaging the tear strips, thereby accomplishing entry without a readily visible indication thereof.

The tamper indicator for a container closure disclosed in U.S. Pat. No. 4,037,748 is an improvement over the just mentioned devices, as this device includes a notch on the inner surface of a tear strip adjacent to a tab used to operate the tear strip for preventing someone from pushing the cover up by using the tear strip tab. The notch is designed to break on manipulation of the tab. However, even this improved device does not provide readily apparent and non-concealable evidence of attempted entry at locations other than adjacent to the tear tab, and the evidence may be concealed or missed because it is located beneath the tear tab. Additionally, this single notch type of tamper indicator can sometimes be defeated by carefully applying an upward force to the container closure on the side thereof opposite to the notch to either remove the closure or to slip some type of tampering implement under the closure and into the container. Force sufficient to accomplish this can often be applied at locations remote from the notch without breaking the notch.

The tamperproof closure member disclosed in U.S. Pat. No. 4,244,479 includes a plurality of circumferentially spaced apart tear grooves or slits on the outside of a tear-indicating sleeve for indicating attempts to remove or tamper with the tamper-indicating sleeve at various circumferential locations, and thus is an improvement over the previously patented devices. However, these grooves on the outside of the tamper-indicating sleeve are subject to providing evidence which might be erroneously confused with the grooves themselves and thus missed or overlooked during a casual inspection. The location of each groove is readily apparent to a prospective tamperer, and if breaking the groove cannot be avoided, the break may be sufficiently concealed within a groove to be missed by a consumer who may not be consciously looking for such evidence. Further, material might be injected to conceal a break in the innermost surface of a groove.

There is no provision in any prior art closure tamper indicator for automatically orienting the forces tending to produce the evidence of tampering so those forces are always applied to the most sensitive portions of the tamper indicator. It can be quite important to both the consumer and the seller to know of attempted entries as well as actual entries because of the potential problems which could arise from tamper damaged products.

The prior art therefore, has failed to provide a tamper indicator for a reclosable container which provides immediately apparent, unconcealed evidence at a number of locations that the container has been tampered with.

DISCLOSURE OF THE INVENTION

It is the main object of the present invention to provide a tamper indicator for use on recloseable container assemblies which provides readily apparent and non-concealable evidence of attempted or actual entry into a closed container at any location on the periphery of the container closure.

It is another object of the present invention to provide a tamper indicator for use on reclosable container assemblies which tends to provide obvious and increased evidence of tampering as attempts to tamper with the reclosable container assembly are increased.

It is a further object of the present invention to provide a tamper indicator for use on reclosable container assemblies which automatically directs forces created by attempted or actual tampering to the most sensitive locations on the tamper indicator.

These and other objects are accomplished by the tamper indicator embodying the present invention. The tamper indicator includes a tear-off strip attached to a skirt of a closure member for a container having a locking ledge thereon. The juncture between the tear-off strip and the closure member skirt is formed by a notch or groove which receives the container locking ledge. A plurality of spaced apart grooves are defined in the tear-off strip inner surface and are located at a plurality of locations about the circumference of the container. The grooves extend only partially through the tear-off strip so that the outer surface of the tear-off strip appears essentially continuous and uninterrupted and the grooves are not clearly visible. A thin web covers each groove to conceal the presence of the grooves or openings in the tear-off strip outer surface. The tear-off strip is sized and adapted to break at the webs whenever the closure member is moved toward disengagement from the container member. Furthermore, the grooves define arcuate sections of the tear strip which pivot about the locking ledge receiving groove when two adjacent grooves are broken. Thus, attempted entry into a closed container at any location on the closure member-container interlock will produce a discontinuity in the outer surface which is therefore apparent and non-concealable. The tear-off strip is sized to be biased toward the container so that when a web breaks, the tear-off strip tends to separate to provide additional tamper indicating evidence and to prevent its concealment. Since the tear-off strip can also pivot about its connection to the closure member skirt, any break in a web tends to separate in several directions, thus providing obvious evidence of tampering.

BEST MODE FOR CARRYING OUT THE INVENTION

Figure 1:
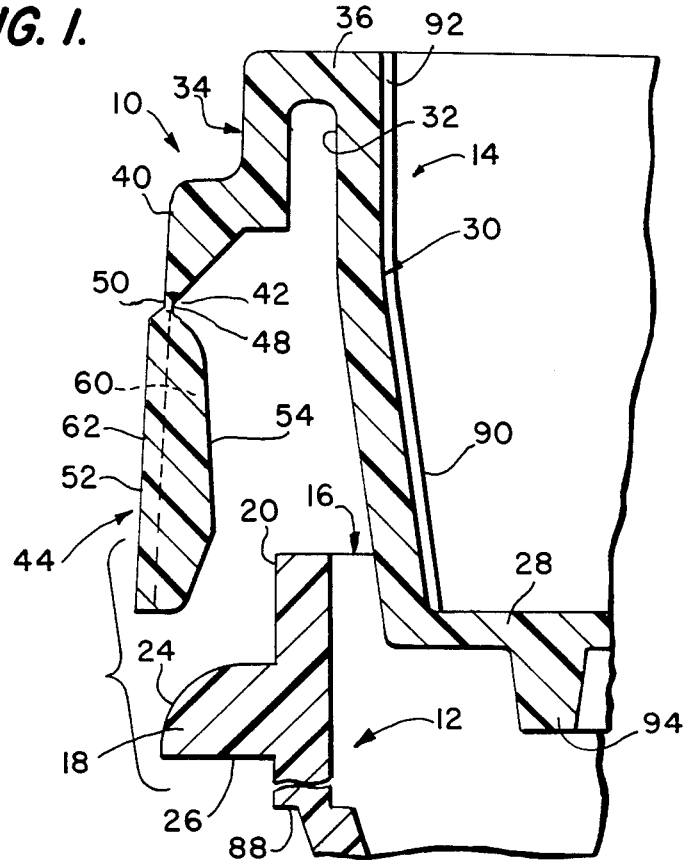
FIG. 1 is a sectional view of a portion of reclosable container assembly including a tamper indicator embodying the present invention.

Shown in FIG. 1 is a reclosable container assembly 10 which includes a container 12 and a closure member 14 for covering an open mouth 16 of the container. A locking ledge 18 is located on an outer surface 20 of the container adjacent to but spaced below the open mouth 16, and extends circumferentially around the container. In the orientation shown for container 12 in FIG. 1, the locking ledge has an upper bearing surface 24 and a lower surface 26.

Closure member 14, which is preferably of unitary construction, includes a central portion 28 for covering the container open mouth, and a raised, circumferentially extending edge portion 30 for attaching the closure member to the container. The edge portion includes a container engaging wall 32 and a skirt 34 connected to the wall 32 by a bight section 36. The wall 32, skirt 34 and bight section 36 form a structure having an inverted "U" shaped cross-section to receive the annular edge of the container 12 which surrounds the opening 16. The skirt 34 includes a circumferentially extending notch 42 sized and located to receive and engage the locking ledge 18 to attach closure member 14 to the container 12.

A tamper indicator and tear-off strip is provided to indicate tampering with the closure member 14. The tamper indicator and tear-off strip 44 is attached to skirt lower rim 48 by a hinge 50 which forms a tear line. The tear-off strip 44 has an outer surface 52 which forms a continuation of the skirt outer surface 40 so that prior to activation of the tamper indicator, the overall outer surface composed of surfaces 40 and 52 is essentially continuous and unbroken. Outer surface 52 may, however, include suitable identifying terms or other indicia. The tear-off strip also includes an inner surface 54 which extends to notch 42. Notch 42 engages ledge lower surface 26 to lock the closure member to the container so that removal of the closure member from the container requires that the tear-off strip be moved out of engagement with ledge lower surface 26. Tamper indicator and tear-off strip 44 further includes a plurality of grooves 60 defined in inner surface 54 of the tear-off strip. The grooves are spaced apart along the inner surface of the tear-off strip and are located at a plurality of positions about the circumference of the container when the closure member and tear-off strip are attached to the container. The grooves 60 are positioned in the tear-off strip 44 to extend from the hinge 50 substantially parallel to the longitudinal axis of the container, but could also extend into the skirt 34. The grooves are defined to extend partially through the tear-off strip so that a web portion 62 of the tear-off strip outer surface 52 covers each groove, concealing the presence of the grooves so that they are not visible through the tear-off strip outer surface 52. The grooves 60 define a plurality of arcuate sections 63 which form the tamper indicator and tear-off strip 44. Because the tear-off strip is thinner at the web portions 62 than at other locations on the arcuate sections 63, movement of the tear-off strip for disengagement from the container causes at least one of the webs to break, thereby providing evidence that tampering has occurred.

Figure 2:
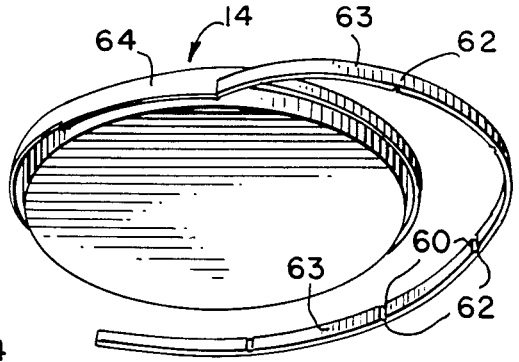
FIG. 2 is a perspective view showing the closure member of the present invention having the tear-off strip partially torn off.
Figure 3:
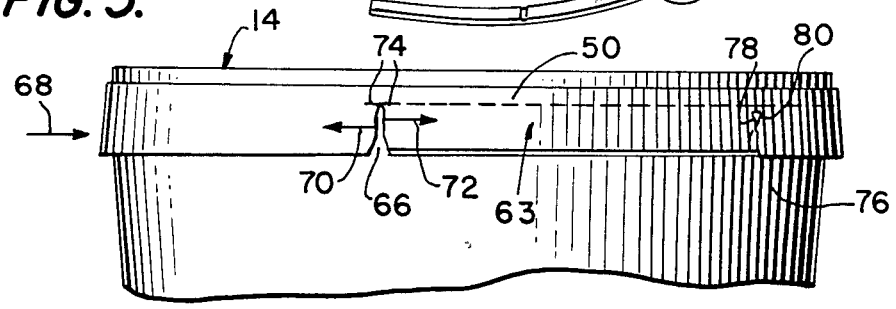
FIG. 3 is a side elevation view of a portion of a container and closure with the tamper indicator embodying the present invention activated in two different modes.

Authorized opening of the container is accomplished in a manner indicated in FIG. 2 by breaking the webs adjacent to a tab 64, removing the tear-off strip 44, and then using tab 64 to lift the closure member 14 from the container 12. However, unauthorized opening of the container will also require the movement of the skirt lower edge 48 of the tear-off strip 44 which will cause the breaking of a web. Since the outer surface 52 of the skirt and tear-off strip appears essentially continuous and unbroken as shown in FIG. 3, a broken web 66 will be clearly evident.

The closure member 14, including the tamper indicator and tear-off strip 44 are made of resilient material and are sized so that when the closure member is locked in place on the container, circumferentially directed tension is established in both the skirt 34 and in the tear-off strip 44. This tension biases the tear-off strip toward the container in the direction indicated by arrow 68 in FIG. 3, and also establishes a force tending to separate the web 62, as indicated by arrows 70 and 72 in FIG. 3. The circumferentially directed forces tend to enlarge the separation of a broken web 66, thus providing increased evidence of tampering once the web 62 is broken.

The break 66 is also shown as including torn portions 74 to illustrate how a break might occur if a closure member removing force is applied near a web. However, if this force is applied to the arcuate section 63 of the tear-off strip 44 intermediate two adjacent webs, both webs will break. FIG. 3 illustrates breaks 66 and 76 at each end of an arcuate section 63 of the tear-off strip 44. The circumferential tension will cause the freed tear-off strip arcuate section 63 to pivot radially outwardly of the container about a pivot point formed by the hinge 50. This action moves the freed arcuate section of the tear-off strip 44 away from the attached arcuate section in a direction different from the circumferential separating movement associated with arrows 70 and 72. Thus, a tear in 62 is likely to cause adjacent arcuate sections of the tear-off strip 44 to be spaced from each other circumferentially of the container, as indicated at break 66 as well as radially of the container as indicated by the overlapping of adjacent edges 78 and 80 of two adjacent arcuate sections in the area of break 76. The ability of the adjacent arcuate sections 63 of the tear-off strip 44 to move in two directions after the web 62 covering adjacent grooves is broken further further enhances the visibility of the break, or breaks, in the otherwise continuous outer surface of the tear-off strip.

Elements which permit stacking of the closure member and container can include a stacking shoulder, such as shoulder 88 shown in FIG. 1 on the container 12 or stacking ribs 90 on outer surface 92 of the closure member wall 32. Also, the bottom wall of the closure member may be provided with a stacking ring 94.

The described container and closure member assembly operates as follows. After an open container is filled with material, the closure member 14 is engaged over the open mouth of the container. Locking ledge 18 of the container presses against inner surface 54 of the tear-off strip 44 to move that element outwardly. The tear-off strip is not permanently deformed by such outward movement, but will yield elastically owing to the resiliency of the plastic material which is preferably used to form the container and closure member. Weakened section 50 acts as a resilient hinge connection about which the tear-off strip 44 pivots as described hereinabove. As the closure member is applied to the container, but before the upper rim of the container wall makes contact with inner surface of the closure member beneath the bight section 36, notch 42 of the skirt 34 snaps over ledge 18 of the container. Immediately thereafter, due to the elasticity of the material, tear-off strip 44 and skirt 34 return to their previous, unstretched positions. Thus, the tear-off strip inner surface, which has been pressed outwardly springs back to its position of rest due to the elasticity of the material. The inner surface of the tear-off strip 44 will then be located beneath ledge 18 on the container wall and accordingly secures the closure member against back movement and also against undetectable opening. This closure member is thus locked on the container.

In order to open a closed container, the tear-off strip 44 of the skirt 34 must be moved radially outwardly away from the container, thereby stressing the tear-off strip. Movement of the tear-off strip 44 away from the container ledge engaging position shown in FIG. 3 at any location along the circumference of the tear-off strip will break at least one web. Due to the normally unbroken and continuous nature of the outer surface 52 of the skirt and tear-off strip, any break will be readily evident and unconcealable. Once the tear-off strip is completely removed, the closure member is no longer locked to the container, and the remainder of the closure member, without the tear-off strip, can be easily removed from the container and reapplied as many times as desired to temporarily close the container. The movement of tab 64 upwardly exerts a lever action to move notch 42 slightly away from ledge 18, thus relieving pressure created by the attachment of the closure to the container so that the closure member can be easily removed from the container wall.

Figure 4:
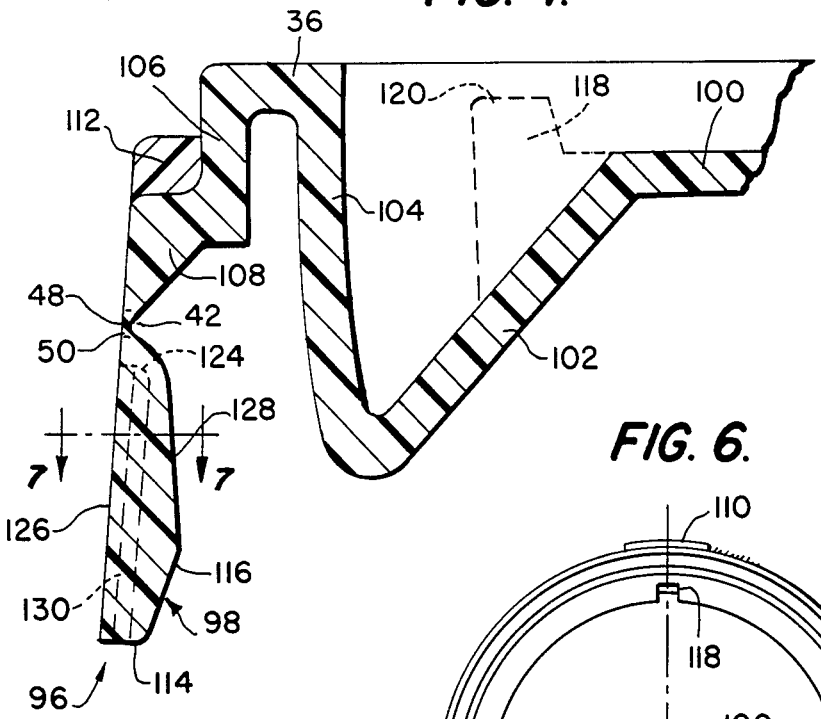
FIG. 4 is a sectional view of a portion of a second embodiment of a container closure which includes the tamper indicator of the present invention.
Figure 5:
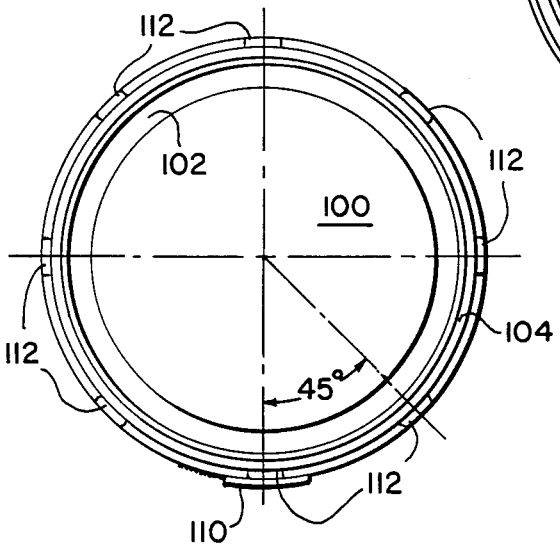
FIG. 5 is a plan view of the closure of FIG. 4.

The tamper indicator and tear-off strip 44 of FIG. 1 may take several different forms, and may be effectively employed with container closures of a number of different styles and sizes. For example, the container closure may be a recessed closure of the type shown by FIG. 1, or a flat closure, and these closures may be formed of all sizes. Referring to FIGS. 4 and 5, a different type of closure indicated generally at 96 is provided with a modified tamper indicator and tear-off strip 98. In the description of FIGS. 4 and 5, structures which are identical to those illustrated in FIG. 1 will be provided with the same reference numeral.

The closure member 96 includes a central flat section 100 which is connected to a surrounding downwardly and outwardly sloping frusto-conical section 102. The lower end of this frusto-conical section is connected to the bight section 36 by an upwardly extending, circumferential wall 104. Spaced from the wall 104 by the bight 36 is a downwardly extending leg 106 which, with the wall 104 and bight 36 defines an inverted U-shaped section receive the annular edge of the container 12. The lower edge of the downwardly extending leg 106 cooperates with an outwardly and downwardly extending second leg 108 formed at the bottom portion thereof to define the upper section of the notch 42. The lower end of this second leg 108 terminates at the hinged circumferential tear line 50 which joins the bottom end of the second leg to the tamper indicator and tear-off strip 98. Thus the tamper indicator and tear-off strip may be separated from the leg 108 along the tear line 50 in a conventional manner by pulling the tear-off strip away from a circumferentially extending tab 110 which is initially attached to the tamper indicator and tear-off strip.

The closure member 96 may be provided with different types of structures which facilitate stacking and nesting of the closures. For example, instead of the stacking ring 94 of FIG. 1, the closure may be provided with stacking pads 112 formed externally of the downwardly extending leg 106 and resting on top of the outwardly extending leg 108. As shown in FIGS. 4 and 5, eight of these stacking pads are formed at 45 degree angles around the circumference of the closure member 96. When these stacking pads are employed, the lowermost edge 114 of the tamper indicator and tear-off strip, which includes a chamfer 116 that angles outwardly and upwardly therefrom, will rest on the top of the stacking pads 112 when the closure members 96 are stacked. This is permitted by the outwardly and downwardly extending leg 108 which positions the inner surfaces of the tamper indicator and tear-off strip outwardly from the downwardly extending leg 106.

Figure 6:
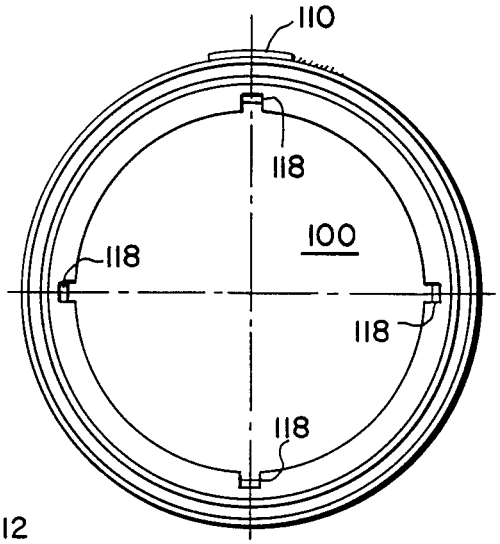
FIG. 6 is a plan view of a second embodiment of the closure of FIG. 4.

An alternate stacking structure for the closure members 96 would be the use of nesting pads 118 in place of the stacking pads 112. The structure of these nesting pads is illustrated in dotted lines in FIG. 4, while the position of the nesting pads is depicted in FIG. 6. As will be noted from FIG. 4, the nesting pads extend circumferentially from the outermost edge of the flat section 100, and project upwardly from the frusto-conical section 102 to a flat upper support edge 120 which is substantially parallel to, but spaced above, the upper surface of the flat section 100. When the closure members 96 are stacked, the flat surface 120 of the nesting pads 118 engages the under surface of the frusto-conical section 102 and permits the closures to nest.

Figure 7:
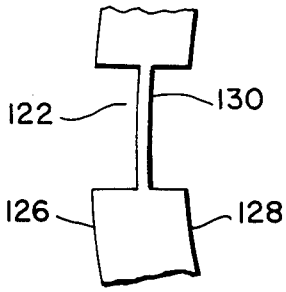
FIG. 7 is a sectional view of a portion of the closure of FIG. 4 taken along lines 7—7.

The tamper indictor and tear-off strip 98 has been modified from the strip 44 of FIG. 1, as will be noted from FIGS. 4 and 7. In FIGS. 1 and 2, the grooves 60 were formed in the rear surface 54 of the tear-off strip and extend from the bottom edge thereof to the score line and hinge 50. These grooves extended from the back surface of the tear-off strip through the tear-off strip to a point which was adjacent to but spaced inwardly from the outer surface 52 thereof. This caused the outer surface to form a thin membrane or web over the surface of each of these grooves.

In the tamper indicator and tear-off strip 98 of FIGS. 4 and 7, a plurality of spaced grooves are formed which extend from the bottom 114 of the strip to a groove top edge 124 which is spaced below the hinge 50. As will be noted from FIG. 7, these grooves extend inwardly from both the outer surface 126 and the inner surface 128 of the tamper indicator and tear-off strip, and terminate to form a thin central web 130. The web 130 operates in the same manner as the web 62 of FIGS. 1 and 2 and ruptures when an attempt is made to pry up on the tamper indicator and tear-off strip. On the other hand, the web 130, like the webs 62 are sufficiently flexible to permit the tamper indicator and tear-off strip to expand and snap over the locking ledge 18 on the container 12.

In both the closure member 14 of FIG. 1 and 96 of FIG. 4, the tear line 50 terminates on either side of the tabs 64 and 110, so that these tabs remain when the tear-off strip is removed. The grooves 60 and 122 are evenly spaced around the tamper indicator and tear-off strip and the number sufficient to ensure rupture of a groove in response to tampering is provided. Generally, this number will be determined by a circumference of the closure employed, but for most closures, eight to twelve grooves have been found to be sufficient.

INDUSTRIAL APPLICABILITY

The tamper indicator of the present invention is most useful for a food container assembly, but will find application on any type, size, or shape container and closure assembly having contents for which protection from tampering is desired.

We claim:

1. A tamper indicator for use with a reclosable container assembly which includes a container having a locking ledge thereon and a closure member having a skirt thereon which engages the locking ledge to attach the closure member to the container, the tamper indicator comprising:

a tear-off strip means attached to the skirt for locking the closure member to the locking ledge, including (1) an inner surface having a portion thereof adapted to engage the locking ledge, (2) an outer surface on a side of said tear-off strip means opposite to said inner surface, and (3) a plurality of spaced apart grooves defined in said tear-off strip means inner surface to be located at a plurality of positions about the circumference of the container when the closure member and said tear-off strip means are assembled with the container, and (4) web means covering said grooves so that grooves are not present in said tear-off strip means outer surface whereby said tear-off strip means outer surface forms an essentially uninterrupted and continuous surface, said web means being adapted to break whenever any part of said tear-off strip means inner surface is moved for disengagement from the locking ledge for producing a discontinuity in said tear-off strip means outer surface and providing an indication of attempted or actual opening of a closed container.

2. The tamper indicator defined in claim 1 further including hinge means for attaching said tear-off strip means to the closure member skirt and wherein said grooves extend away from said hinge means.

3. The tamper indicator defined in claim 2 wherein said tear-off strip means is biased toward the container when the closure member is attached to the container with the biasing causing a tear strip section located between adjacent grooves to pivot about said hinge means away from the container when web means in the adjacent grooves are both broken.

4. The tamper indicator defined in claim 2 wherein said hinge means extends circumferentially of the closure member and is adapted to break when said web means breaks to guide a break circumferentially about the container for enlarging a break occurring in a web means.

5. The tamper indicator defined in claim 1 wherein the skirt includes an outer surface which is contiguous with said tear-off strip means outer surface an both of said outer surfaces are essentially continuous and uninterrupted.

6. A tamper indicator for use with a reclosable container assembly which includes a container having a locking ledge thereon and a closure member having a skirt thereon which engages the locking ledge to attach the closure member to the container, the tamper indicator comprising:

a tear-off strip means attached to the skirt for locking the closure member to the locking ledge, including (1) an inner surface having a portion thereof adapted to engage the locking ledge, (2) an outer surface on a side of said tear-off strip means opposite to said inner surface, (3) a plurality of arcuate sections spaced from each other to define a gap between adjacent sections, said gaps being spaced apart to be located at a plurality of positions about the circumference of the container when the closure member and said tear-off strip means are assembled with the container and (4) web means connecting adjacent sections together and covering the gaps between said adjacent sections so that gaps are not present in said tear-off strip means outer surface whereby said outer surface is essentially continuous and uninterrupted, said web means being adapted to break whenever some part of said tear-off strip means inner surface is moved from disengagement with the locking ledge for producing a discontinuity in said tear-off strip means outer surface and providing an indication of attempted or actual opening of a closed container.

7. A closure member and tamper indicator for use with an open ended container having a container lip extending around said open end and an external locking ledge including an upper section and a lower section formed on said container below said lip to attach the closure member over the open end of the container to form a reclosable container assembly comprising:

(1) a cover section adapted to extend over the open end of said container, (2) a generally inverted U-shaped section for receiving said container lip, said U-shaped section having inner leg means for engaging an inner surface of said container and an outer leg means for engaging an outer surface of said container, said inner leg means being connected to said cover section and said outer leg means having a lower terminal end section with an inner surface configured to receive the upper section of said locking ledge.

(3) a tamper indicator and tear-off strip secured to said lower terminal end section of the outer leg means and having a lower edge which forms the lower extremity of said closure member and tamper indicator, said tamper indicator and tear-off strip including a strip inner surface configured to receive the lower section of said external locking ledge, (4) and a tear-line means connecting said tamper indicator and tear-off strip to the lower terminal end section of said outer leg means, (5) said tamper indicator and tear-off strip including a plurality of spaced apart grooves formed in said tamper indicator and tear-off strip and extending around the extent thereof, said grooves extending upwardly from the lower edge of said tamper indicator and tear-off strip and inwardly to a thin, flexible membrane which extends across and bridges each said groove.

8. The closure member and tamper indicator of claim 7 wherein each said groove extends inwardly from the strip inner surface to said thin flexible membrane, said thin flexible membrane forming a strip outer surface for said tamper indicator and tear-off strip.

9. The closure member and tamper indicator of claim 7 wherein said tamper indicator and tear-off strip includes a strip outer surface, each said groove extending inwardly from said strip inner and outer surfaces to said thin, flexible membrane.

10. The closure member and tamper indicator of claim 7 wherein a tab means is secured to the lower terminal end section of said inner leg means and extends downwardly therefrom, said tab means having spaced, opposite ends connected to said tamper indicator and tear-off strip which extends between said spaced opposite ends, said tear line terminating at said spaced opposite ends.

11. The closure member and tamper indicator of claim 10 wherein said tab means includes a tab inner surface configured to receive the lower section of said external locking ledge, said tamper indicator and tear-off strip being connected to each of the opposite ends of said tab means by one of said grooves defining a membrane extending between an end of said tab means and said tamper indicator and tear-off strip.

* * * * *